US008928458B2

(12) United States Patent
Fortin et al.

(10) Patent No.: US 8,928,458 B2
(45) Date of Patent: Jan. 6, 2015

(54) FLOW CONTROL GATE AND METHOD

(76) Inventors: Régis Fortin, Laval (CA); André Lafleur, Boucherville (CA)

( * ) Notice: Subject to any disclaimer, the term of this patent is extended or adjusted under 35 U.S.C. 154(b) by 15 days.

(21) Appl. No.: 13/573,320

(22) Filed: Sep. 11, 2012

(65) Prior Publication Data

US 2013/0205666 A1 Aug. 15, 2013

Related U.S. Application Data

(60) Provisional application No. 61/633,399, filed on Feb. 10, 2012.

(51) Int. Cl.

| | |
|---|---|
| ***E06B 11/02*** | (2006.01) |
| ***G08B 23/00*** | (2006.01) |
| ***E05F 15/20*** | (2006.01) |
| ***G07C 9/02*** | (2006.01) |

(52) U.S. Cl.

CPC ..... *E06B 11/022* (2013.01); *E05F 15/2084* (2013.01); *G08B 23/00* (2013.01); *E05F 15/2092* (2013.01); *E05F 15/2023* (2013.01); *G07C 9/025* (2013.01)

USPC ..... 340/5.7; 340/573.1; 49/49; 49/13; 49/25; 49/29

(58) Field of Classification Search

CPC ..... G07C 9/00; G07C 9/025; G08B 13/183; E05F 15/2023; E05G 5/003; E05Y 2900/40

USPC ..... 340/5.7, 573.1, 573.3, 573.4; 250/221; 49/31, 42–47

See application file for complete search history.

(56) References Cited

U.S. PATENT DOCUMENTS

| | | | | |
|---|---|---|---|---|
| 3,606,698 | A * | 9/1971 | Tanaka et al. | 49/35 |
| 4,121,192 | A * | 10/1978 | Wilson | 367/129 |
| 5,493,273 | A * | 2/1996 | Smurlo et al. | 340/541 |
| 5,898,367 | A * | 4/1999 | Berube | 340/505 |
| 6,185,867 | B1 * | 2/2001 | McGuire | 49/109 |
| 2004/0093181 | A1 * | 5/2004 | Lee | 702/150 |
| 2004/0135072 | A1 * | 7/2004 | Huff | 250/221 |
| 2005/0133701 | A1 * | 6/2005 | Anderson | 250/221 |
| 2007/0271846 | A1 * | 11/2007 | Miller et al. | 49/49 |
| 2010/0324841 | A1 * | 12/2010 | Tasher et al. | 702/57 |
| 2012/0053726 | A1 * | 3/2012 | Peters et al. | 700/252 |
| 2012/0241624 | A1 * | 9/2012 | McLaughlin | 250/341.1 |

FOREIGN PATENT DOCUMENTS

| | | | |
|---|---|---|---|
| DE | 9314530 | * | 4/1993 |

* cited by examiner

*Primary Examiner* — Benjamin C Lee
*Assistant Examiner* — Rajsheed Black-Childress
(74) *Attorney, Agent, or Firm* — Benoît & Côté Inc.

(57) ABSTRACT

A flow control gate system that comprises a first and second elongated barrier members defining a passageway between a first area and a second area. The gate system also comprises a plurality of narrow beam presence sensors with substantially constant spacing therebetween defining a linear array mounted along the first barrier member and defining a presence detection beam orientation crosswise and substantially perpendicular to the passageway. The gate system further comprises a controller electrically connected to the plurality of narrow beam presence sensors. The controller implements an operating program to process signals from the plurality of narrow beam presence sensors and define valid detection periods to determine that an item is detected when a detection period is equal to or longer than a predetermined value and invalid detection periods interpreted as no detection when a detection period is shorter than the predetermined value. A flow control method is further provided.

7 Claims, 4 Drawing Sheets

FLOW CONTROL GATE AND METHOD

FIELD

The present application relates to means for controlling the passage of items from an area to another. More specifically, but not exclusively, the present invention is concerned with a gate system and method for monitoring and controlling the flow of items such as persons or objects, particularly for assessing flow direction and detecting, signaling and discouraging counter-flow passages.

BACKGROUND

In many circumstances, it is desired to provide a gate to enable access of persons in one direction, i.e. from a first area to a second area, while preventing or at least detecting circulation in the opposite direction. Such control is required for example to enable people to freely enter a store through certain portals while exit is only permitted through other portals.

Turnstiles are often used for such a purpose, but they present important limitations since they do not provide detection of a person jumping across the gate to exit, they present a serious hindrance to the passage of handicapped persons and shopping carts, and they are not adapted to enable free circulation in the opposite direction to let people freely exit the controlled area in case of emergency such as in the event of a fire alert. Similarly, gates comprising two or more sequential interlocked arms, wherein the first arm must be opened to unlock the second arm, may also be fooled by having a person keeping the first arm open thus enabling other persons to exit.

A number of more sophisticated gates and barriers have been provided in the prior art in attempt to overcome the above limitations and drawbacks, most of them relying on a simple motor driven pivotal arm and different sensing devices to manage arm operation in connection with people detection to allow one-way or two-way circulation of incoming persons while preventing arm/people interferences. This prior art solution discloses a passage barrier comprising a swiveling barrier and at least one sensor technology located in the sidewalls along the passageway and emitting a detection wave to detect the presence of a person in the swiveling area and/or the swiveling angle of the barrier. The prior art further teaches that multiple sensors may be used to determine the position and direction of movement of the person and that the barrier is at least partly made of detection wave transparent material.

However, it is well known that this type of system based on a motor driven barrier automatically opening when presence of an incoming person is detected presents a poor performance for preventing persons from exiting through the barrier when it is open to let other persons enter. While gates according to this concept keep the barrier arm locked in a closed position as long as no person has been detected at the entry end, they suffer from the same limitation as the interlocked arms when presence is detected at the entry end. Furthermore, in addition to presenting a risk of hurting a person in case of misdetection; this type of motor driven barriers moving slowly for safety concerns limits the circulation flow speed. In spite of the number of sensors that can be used according to concepts of the prior art, no indication is disclosed as to the method of controlling the barrier as a function of the signals provided by these sensors, especially in the case of multiple discontinuous detections along the passageway, momentary detections, etc.

It would therefore be a significant advance in the art of gate systems to provide a gate and method enabling accurate detection and tracking of the flow of individual detectable items, such as persons, animals or objects, passing through a gate system and taking appropriate actions without the need for a motor driven barrier arm, thereby providing accurate flow control as a turnstile, without the associated drawbacks.

Therefore, there is a need to provide a flow control gate and associated advanced method to obviate the limitations and drawbacks of the prior art.

SUMMARY

It is a broad aspect of an embodiment to provide flow control gate system comprising:

a first and second elongated barrier members defining a passageway between a first area and a second area;

a plurality of narrow beam presence sensors with substantially constant spacing therebetween defining a linear array mounted along a barrier member and defining a presence detection beam orientation crosswise and substantially perpendicular to the passageway, and a controller electrically connected to the plurality of narrow beam presence sensors and implementing an operating program to process signals from the plurality of narrow beam presence sensors and define valid detection periods to determine that an item is detected when a detection period is equal to or longer than a predetermined value and invalid detection periods interpreted as no detection when a detection period is shorter than said predetermined value.

It is another broad aspect of an embodiment to provide a method for monitoring and controlling a flow of detectable items through a passageway, the method comprising:

providing a linear array having a plurality of narrow beam presence sensors along the passageway, from an entry end to an exit end, for generating detection signals indicative of the presence of a detectable item;

reading signals from the plurality of narrow beam presence sensors in sequence at predetermined time intervals;

allocating a detection value to each sensor, the detection value for each sensor is zero (0) if a detection period of the corresponding signal is less than a predetermined value and one (1) if the detection period is equal to or larger than the predetermined value;

generating an item variable when the detection values of a first sensor (S1) and a second sensor (S2) at the entry end pass from zero (0) to one (1) and one (1) to zero (0) respectively from a first reading time interval to a second time interval; and storing detection values representative of an item in the corresponding item variable for a plurality of time intervals, so that a position number representative of the physical position of the item in the passageway at a given time may be calculated by summing the detection values in the item variable for the corresponding time interval and dividing the result by the number of consecutive detection values that are different from zero (0) in the item variable.

BRIEF DESCRIPTION OF THE DRAWINGS

Similar parts are identified by identical or similar numbers throughout the drawings. In the appended drawings.

DETAILED DESCRIPTION

In the following description, for purposes of explanation and not limitation, specific details are set forth such as particular architectures or techniques. It will be apparent to those skilled in the art that the system and method described hereinafter may be practiced in other embodiments that depart from these specific details.

Figure 1A:
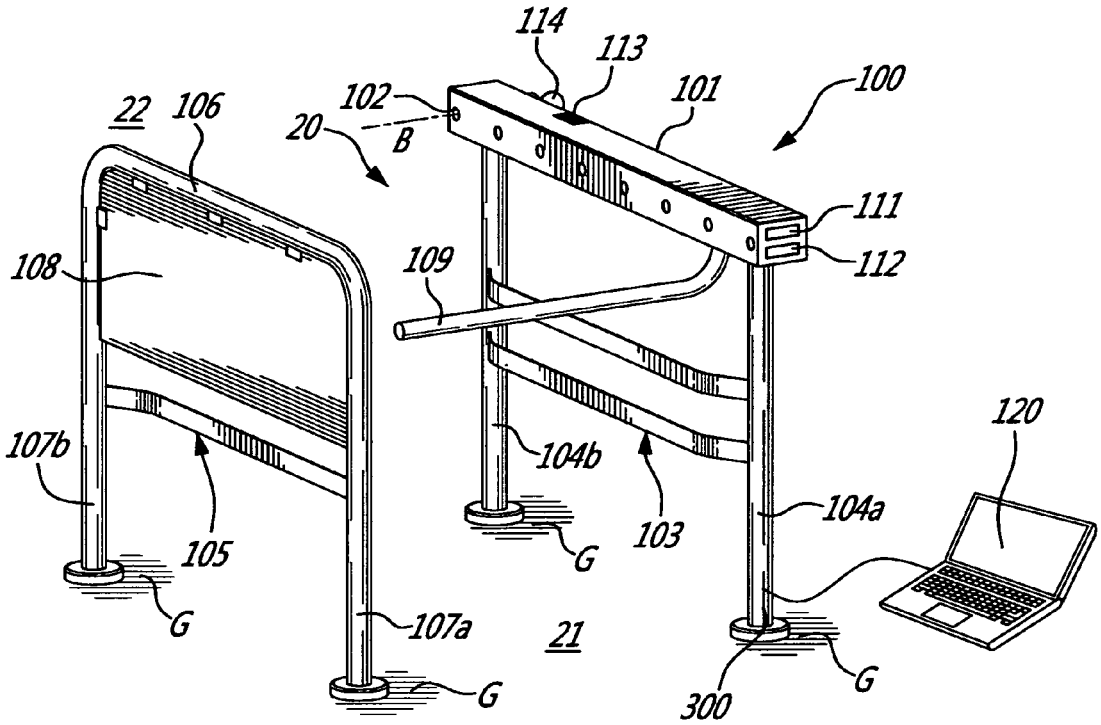
FIG. 1*a* is an isometric view of a flow control gate according to an embodiment.
Figure 1B:
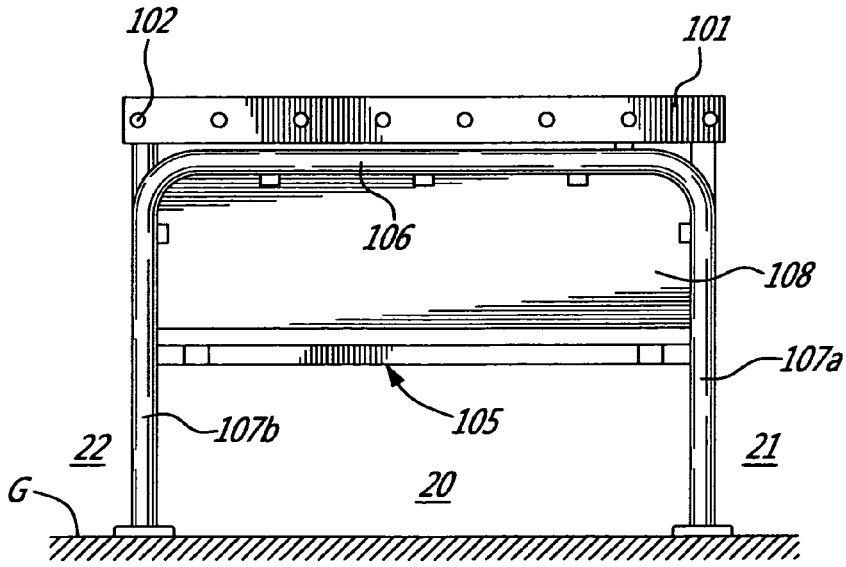
FIG. 1*b* is a side elevation view of the gate of FIG. 1*a;*
Figure 1C:
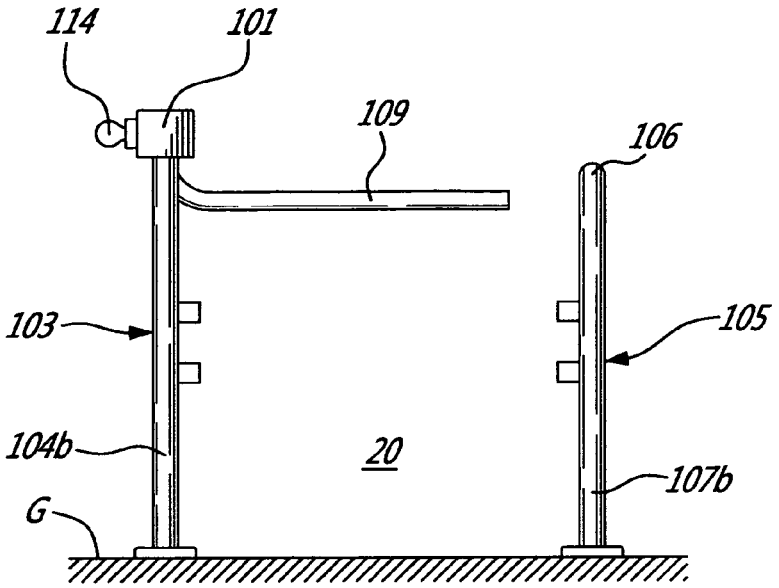
FIG. 1*c* is an elevation view of the gate of FIG. 1*a*, as seen from the exit end thereof.

Referring to FIGS. 1*a-c*, the non-restrictive illustrative embodiment is basically concerned with a flow control gate system 100 for monitoring and controlling a flow of items such as persons, animals or objects circulating in a passageway 20, from an entry end 21 to an exit end 22.

The flow control gate system 100 basically comprises a first top rail 101 provided with a plurality of sensors 102 forming a longitudinal linear array on the inner side of the top rail 101. The flow control gate system 100 may use, for example, from four (4) to approximately eight (8), while not being limited to this number of sensors. Sensors 102 may be retro-reflective photo-sensors projecting a narrow beam B of infrared radiation substantially perpendicularly across the passageway 20. Alternatively, sensors 102 may comprise receptors paired with corresponding emitters provided in an opposite top rail 106, or a combination of sensors of different types. Each sensor 102 is self-contained and comprises an infrared radiation emitter and a detector for detecting IR radiation scattered by an object, an animal or a person passing in passageway 20. Accordingly, other types of narrow beam presence sensors could be used such as ultrasound sensors or active or passive optical sensors using a laser or a narrow beam of light in an appropriate frequency range which provides reliable object detection and prevents false detection. Although a passive type may be preferred for simplicity of construction, an active type of sensor comprising a beam detector to be located across the passageway 20 in alignment with the emitter could be contemplated as well. Such an arrangement is shown in the alternate embodiment illustrated in FIGS. 3*a*, 3*b*, 4*a* and 4*b*, wherein each one of the presence sensors 102 comprises a photoelectric receptor 102' and the second top rail 106 comprises photoelectric emitters 202 in operative alignment with the receptors 102'. The eight photoelectric receptors 102' are conveniently mounted by pair on four printed circuit boards 115 inside the first top rail 101, under the cover 116 provided with narrow beam shaping windows 117 in optical register with each receptor 102'. Reciprocally, the eight photoelectric emitters 202 are conveniently mounted, for example, by pair on four printed circuit boards 215 inside the second top rail 206, under the cover 216 provided with windows 217 in optical register with each photoelectric emitter 202 to enable photo-beams such as B' to exit the rail 201 and strike the detectors 102' when no item, such as an object, an animal or a person may obtrude the direct lines of sight.

In FIGS. 1*a* to 4*b*, the rail 101 is supported on a structure to form a first upright elongated barrier side member 103 anchored to the ground G through legs 104*a*, 104*b*, and defining one side of passageway 20 for preventing passage of items through the side member.

The opposite side of passageway 20 is defined by a second upright elongated structure defining a second barrier side member 105 comprising a second top rail 106, anchoring legs 107*a*, 107*b* mounted on ground G, and a radiation absorbing panel 108 extending from the top rail 106 to absorb energy from beams emitted by sensors 102 when no item is located between a sensor and panel 108. In another embodiment, the panel 108 can be replaced by adapting the second top rail. In FIGS. 3*a*, 3*b*, 4*a* and 4*b* a second top rail 206 is adapted to enclose photoelectric emitters 202 as described above.

A barrier arm 109 can further be mounted to top rail 101 for swiveling movement between a first position across the passageway 20 as illustrated in FIGS. 1*a* and 1*c*, and a second open position wherein the barrier arm 109 extends substantially parallel along rail 101. The barrier arm 109 is invisible for sensors 102 and creates no interference with item detection. For example, the arm 109 can be strategically positioned between the second (S2) and the third (S3) sensors of array 102 for proper operation as described in the following. The barrier arm 109 can be alternatively swiveled towards entrance 21 or towards exit 22. The barrier arm 109 can be mechanically locked in closed position to prevent opening and thereby allow a one-way or two-way flow control gate system 100 through the lock actuating mechanism 118, under the electrical control of a controller 120.

The controller 120 may be remotely connected to the flow control gate system 100 or may be partly or completely integrated into the rail 101. When the controller 120 is integrated into the rail 101, the controller is electrically connected to each sensor 102 through input ports and has output ports driving visual displays 111 and 112, respectively providing green and red gate status signals for indicating a normal or alert condition.

Further peripherals such as a speaker 113 may be connected to and activated by the controller 120 according to detection conditions. The speaker may be replaced with a buzzer, a beeper, etc. The flow control gate system 100 may further comprise a key switch 114 mounted on an outer side of rail 101 and electrically connected to an input of the controller to allow an operator to disable the flow control gate system 100 and allow free circulation across the passageway 20.

In normal operation, when manager key switch 114 is turned ON, the green display 111 is lit and the barrier arm 109 can be freely pushed by a an item such as person, an animal or an object entering the passageway 20 by the entry end 21, as detected by photoelectric sensors 102. If by analysis of the signals from the sensors 102, the controller determines that an item (object, animal, person) or group is entering by the exit end 22 or is circulating from the exit end 22 toward the entry end 21, it can take an action such as locking the barrier arm 109 in its closed position, sounding an alarm through speaker 113, activating the red display 112 (and disabling the green display 111), or driving any other peripheral connected to the controller 120 such as a camera to record a picture or video sequence of the scene taking place within the passageway 20. Even if the barrier arm 109 is open the lock will not be engaged but the rest of the safety devices (buzzer, camera, etc.) will remain functional. If the key switch 114 is turned to OFF, the controller 120 stops monitoring the passageway 20 and the barrier arm 109 can be freely moved in both directions or can be attached along rail 101 in a steady open position and no action will be taken by the controller in any circumstances. Similarly, an input signal from a fire alarm system 300 detected by the controller at any time would also disable the flow control gate system 100 to leave free access from the exit end 22 to the entry end 21 of the flow control gate system 100.

According to the internal operation of the flow control gate system 100, an operating program in the controller 120 monitors signals from the plurality of sensors 102, for example, about ten times per second and carries out calculations to define items (actually objects, persons or animals) and enable determination of item variables such as the current position of each item along the linear axis defined by the sensor array within the passageway 20 (alignment with sensors 102 or exit of the item), specific item flow direction and speed, mean flow direction and speed of items, as well as item passage counters. The operation program operates according to a method described in detail in the following.

Figure 2:
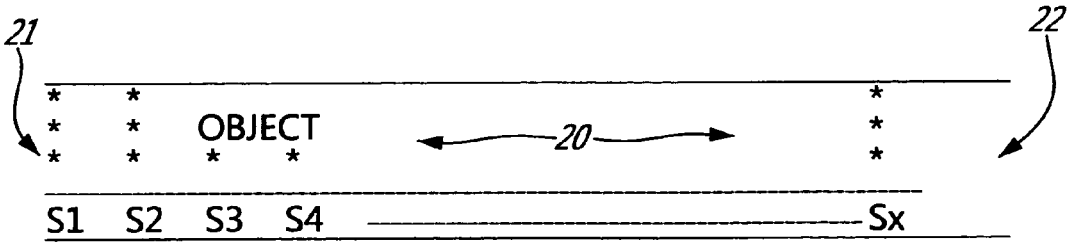
FIG. 2 is a schematic top view of the passageway.
Figure 3B:
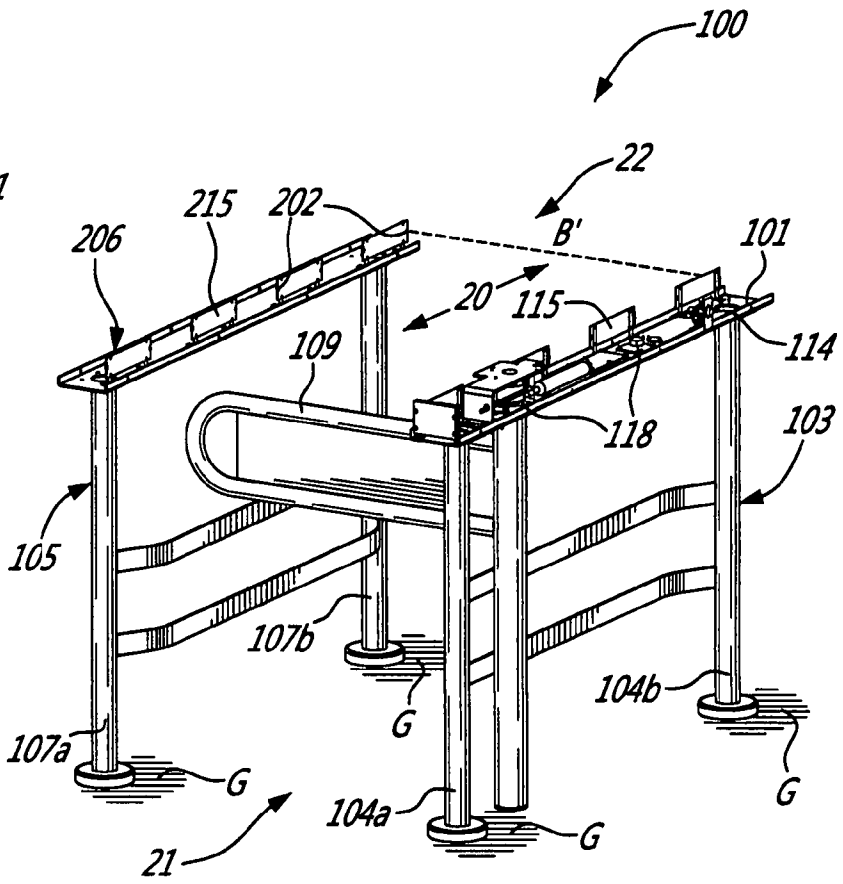
FIGS. 3*a* and 3*b* are right side isometric views of a flow control gate according to an alternate embodiment, respectively with and without top rail covers installed.
Figure 3A:
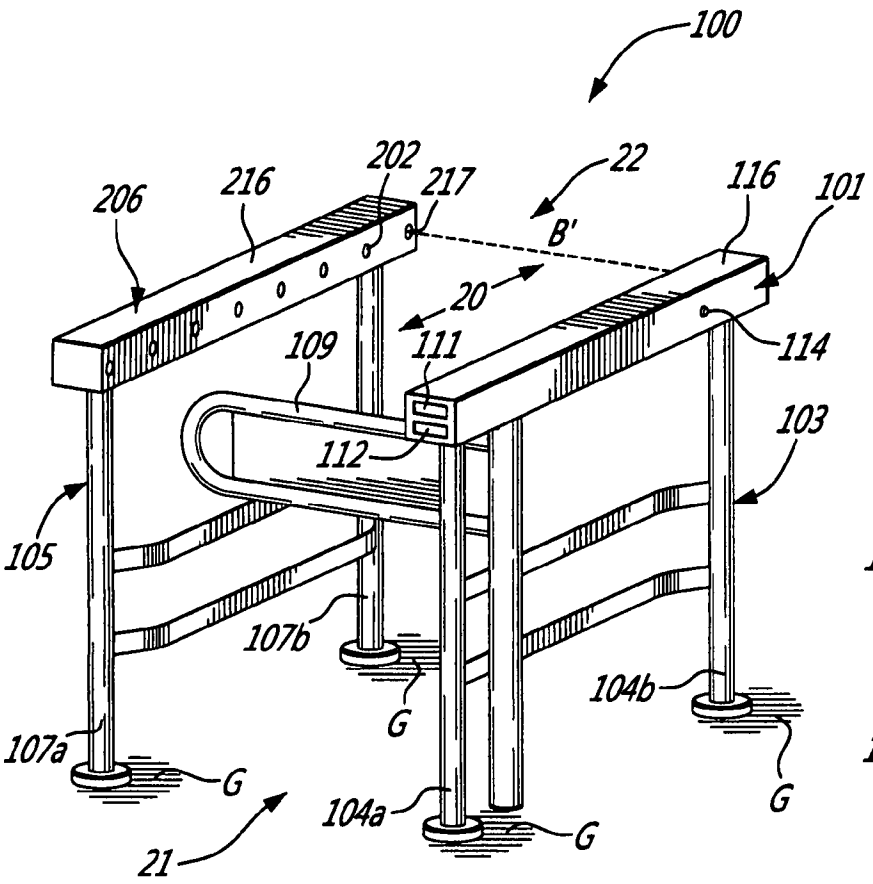
Figure 4B:
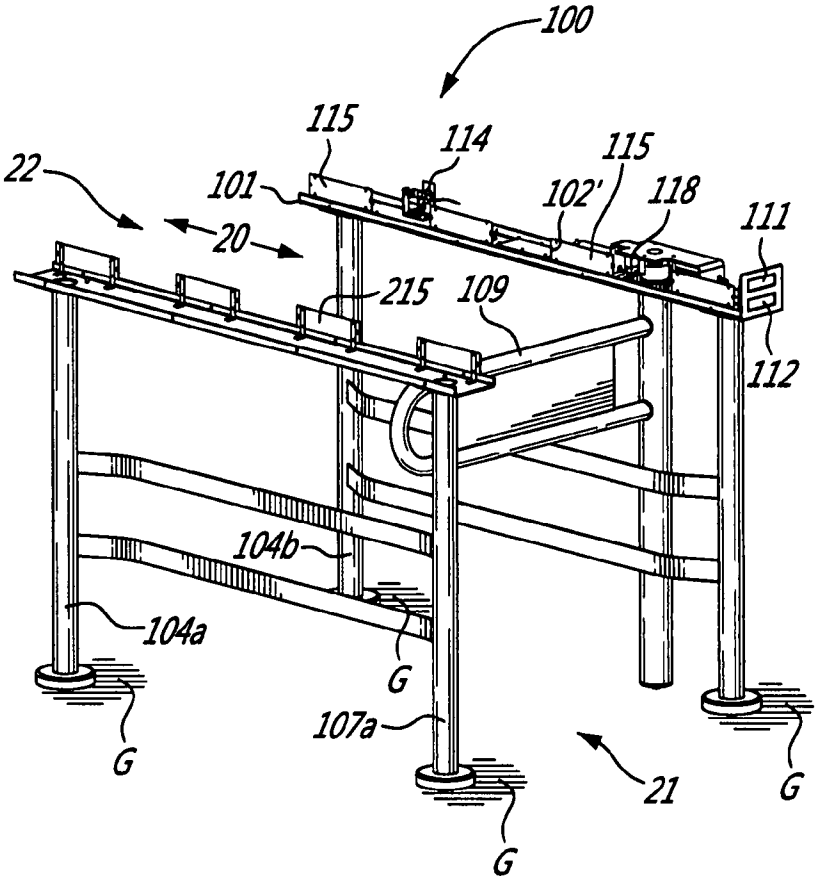
FIGS. 4*a* and 4*b* are respectively a left side isometric view of the gate of FIG. 3*a* and a left hand side isometric view of the gate of FIG. 3*b*.
Figure 4A:
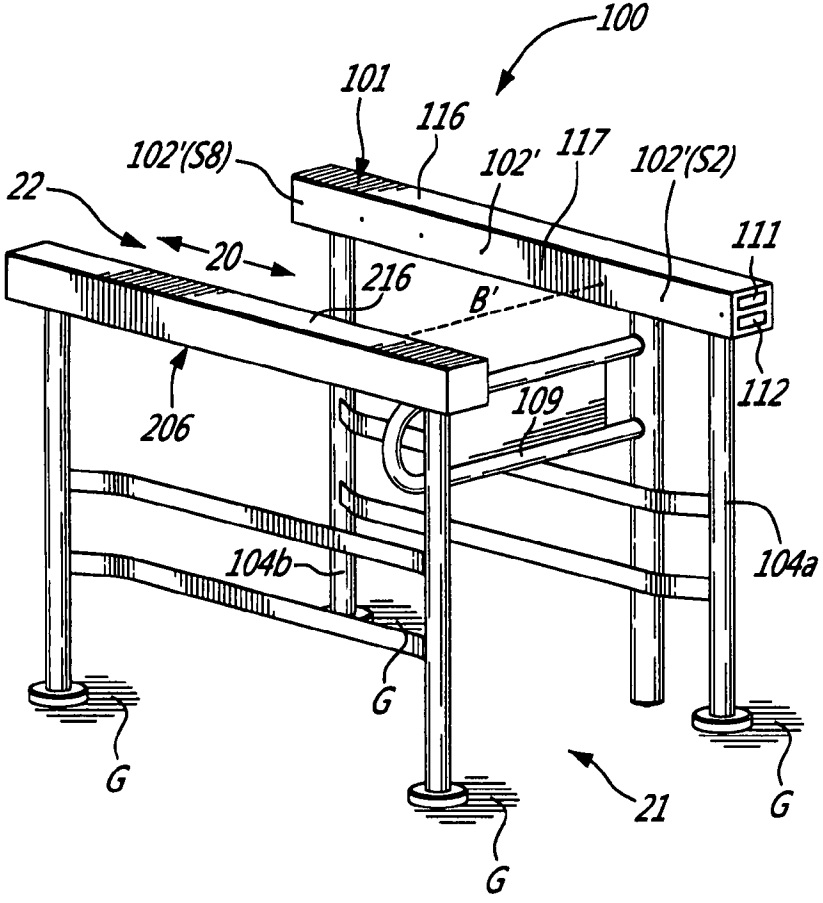

Referring to FIG. 2, a schematic top view of the passageway 20 is represented showing an item identified as OBJECT in the passageway monitored by x photo-beams B from x photoelectric sensors 102 individually identified as S1 to Sx, from the entry end 21 to the exit end 22 of the flow control gate system 100. As long as the objects or persons to be detected are larger than the spacing between adjacent sensors 102, the concept is analog to taking an x pixel image of the passageway 20 and analyzing the image to locate items. Therefore, appropriate spacing of the sensors 102 must be implemented according to the expected size of the items to be detected. For example, it has been found that a sensor spacing between six (6) to ten (10) inches may provide adequate resolution for reliable monitoring of individuals circulation. Each sensor is being allocated a weight value as follows: S1=1, S2=2; S3=3; S4=4; . . . Sx=x.

At every polling sequence, which may occur 10 times per seconds (reading intervals of 0.1 second), if a presence is detected by a sensor 102 for at least a predetermined time period T, the sensor is being attributed an ON status, otherwise, it is being attributed an OFF status. It has been found that positive results were obtainable using a minimal detection time period T of 0.1 second to attribute an ON status to a sensor, and by maintaining the ON status for a predetermined period of time, for example, about 0.3 second after the sensor stops outputting a detection signal. This feature, comparable to a key debouncing feature, is required to take into consideration that a sensor 102 may be momentarily triggered by something that cannot be considered as a person, an object or a group circulating in the passageway 20 at a predictable speed. For example, balancing arms of a person, carried objects or small parts of a shopping cart or basket may thereby be eliminated from the objects/person recognition algorithm for optimal accuracy. Detection values representative of an item, may be stored in an x-dimensional variable for each reading time interval, sensor Sn being given a value equal to 0 for an OFF status and to "n" for an ON status.

Object monitoring: Letting T0 be the current time and T−1 the time before the last time increment, a new item variable is generated every time sensors S1 and S2 were OFF at time T−1 (previous time interval) and S1 becomes ON at time T0 (current time interval) while sensor S2 is still OFF. An item is represented by a y-dimensional variable representing a series of y consecutive ON sensors, wherein Sn takes the weight value n. Therefore, an item variable takes the form O=(Sn, Sn+1, Sn+y). For example, the object in FIG. 2 would be attributed the variable (2, 3) or (0, 0, 2, 3, 0, . . . , 0), for y=2 consecutive sensors ON, sensor S2 and sensor S3.

The current position of an object is then calculated by summing the numbers in the object variable O (2+3=5 in this example) and dividing by the number y of ON sensors (2 in the example), giving a position of 2.5 for this example, meaning that the object is considered to be located between sensor 2 and sensor 3 along the linear axis defined by the photosensors array in rail 101 along the passageway 20. Thus, the current position (distance) Do of any object is given by: Do=Σ(Sn, Sn+1, Sn+y)/y. This method can thus be applied to track more than one object simultaneously if more than one series of consecutive ON sensors separated by at least one OFF sensor can be identified in an x-dimensional variable representing the status of all the sensors S1-Sx at a given time. An item continues to exist in the passageway 20 as long as its position value Do is ≥1 and ≤x, and that at least one sensor in its item variable O remains ON.

Every distinct virtual item created at sensor S1 and reaching sensor Sx corresponds to an actual person or object that really crossed the flow control gate system 100 from the entry end 21 to the exit end 22 of the passageway 20. Therefore, an item counter can be incremented within the controller 120 to accurately track the number of items (persons, animal or objects) who/which crossed the flow control gate system 100 within a given period of time.

Flow determination: The specific flow of an item is given by: Fo=Do (T0)−Do (T−1). If Fo=0, the item is not moving; if Fo, >0, the item is moving in the right direction (toward exit 22), and if Fo is <0, the item is moving in the wrong direction (toward entry 21), which may cause the controller 120 to take an appropriate action.

A representation of the total flow of items in the passageway 20 may also be calculated to determine if an item is trying to circulate in the wrong direction (from the exit end toward the entry end) while at least another item is moving in the right direction at the same time. The total flow Ft=Σ (all Sn ON)/(total number of ON sensors in the array). If Ft=0, the mean flow in the passageway is null; if Ft, >0, all items are moving in the right direction, and if Ft is <0, at least one item is moving in the wrong direction, which may cause the controller 120 to take an appropriate action.

Speed: Since the position of all items is known at all time, and the poling interval is known, a progression speed may be calculated and associated with each item.

According to the above described structure and operation of an embodiment, it is contemplated that operating features may be incorporated as follows, as described in the context of a store entry control, to allow control of a store access with a flow control gate system 100. It can be understood that the flow control gate system 100 is not limited to a store entry control but can also be used in premises or area where the entrance is required or wished to be controlled. For example, the flow control gate system 100 can be used in subway, government facilities, industrial facilities, production lines, etc.

Normal Flow into the Store:

A green light 111 may indicate that a client can walk through the passageway 20. An optional welcome message may be emitted through the speaker 113 to greet a customer while entering the flow control gate system 100.

Should a client stall in the passageway 20, then he/she may be prompted to move forward by a single BEEP alarm signal (SB) from speaker 113.

Should anyone move backward to exit the store through the flow control gate system 100, then a warning message may first warn the client that he/she is circulating in the wrong direction. For example, if a client backs-up a little, a more insistent double BEEP alarm signal (BB) may be sounded through speaker 113.

Should the sensors 102 detect that a client keeps on moving in the wrong direction, creating a negative flow, then a loud alarm sound from a buzzer (LB) in the speaker 113 may be trigged.

If a client moves past sensor S3 (past barrier arm 109), the lock actuating mechanism 118 will not be engaged if whichever other event occurs until the client who entered in the right direction is out of the flow control gate system 100.

Unauthorized Flow from the Store Towards the Entrance:

If no presence is detected, then the system is on standby and the green light 111 is on.

If someone triggers sensor S8, then the flow control gate system 100 will lock the barrier arm 109 and SB will be sounded until the intruder moves back out past sensor S8, unless intruder disappears without passing back out sensor S8, in which case lock would be maintained and a 5 second LB would be triggered.

Whenever an alarm is triggered and sounded through the speaker 113 or whenever the barrier arm 109 is locked, the red light signal 112 at the front end of the flow control gate system 100 may indicate an entering client not to engage in the passageway 20.

The flow control gate system 100 may unlock the barrier arm 109 and return to the green light only if the client leaves the sensor area or generates a positive flow by entering the store.

Should sensors S1 and S2 be triggered by an entering client without opening the arm 109 while sensor S8 is triggered, then the barrier arm 109 will lock and LB will be sounded.

Should sensors S1, S2 and S3 be triggered and the barrier arm 109 is opened by an entering client while sensor S8 is triggered, the LB will be sounded and the lock actuating mechanism 118 will not be engaged.

In any of the preceding events, the flow control gate system 100 will automatically reset itself if there is no presence and if any extended programmed alarm is completed or disabled.

Emergencies, Fire Alarm, Manager Control, Customer Service Control and Power Failures, etc:

If no electrical power supplies the flow control gate system 100, then when the lock actuating mechanism 118 will be disabled and if the barrier arm 109 is fully opened a spring loaded mechanism (not shown) will keep the barrier arm 109 open until power comes back. Then the flow control gate system 109 will reboot and the barrier arm 109 will be released back to its closed normal position.

If the manager's key switch 114 is turned from active to disabled position, the flow control gate system 100 will enter a sleep mode as for power off above, except that the green light 111 will flash until the key switch is positioned to the active mode, which will return the system to its active mode. The key operated mechanism may thus allow a manager to disable the flow control gate system 100 and leave the barrier arm 109 open.

The flow control gate system 100 can be linked to any fire alarm system to be disabled in case of emergency and let a free flow passage in both directions. If the fire alarm input 300 is triggered, then the system 100 may enter a sleep mode as above, with the green light flashing until fire alarm is cancelled. Then, the system returns to its active mode.

A customer service button (not shown) may further be provided on the top rail 101. If the Customer service button is activated and held, then the gate system 100 will enter a sleep mode as above, with the green light flashing, until the button is released. Then the flow control gate system 100 returns to its active mode.

A panic button (not shown) may be provided on the flow control gate system 100 or remotely located to be usable from the store side, and connected to controller 120. If the panic button is activated, then LB will be sounded, the green light 111 will flash alternatively with the red light 112 and the arm 109 will be locked for a period of time such as fifteen (15) seconds, then the lock actuating mechanism 118 will be disabled enabling the barrier arm 109 to be maintained open if moved to its fully opened position in which it would be held by the spring loaded mechanism (not shown). Then the barrier arm 109 can be rearmed by resetting the panic button and operating the manager's key switch 114 to reboot the system.

If the panic button is activated, then LB will be sounded, the green light 111 will flash alternatively with the red light 112 and the arm 109 will be locked. If the panic button is reset within a period of time such as fifteen (15) seconds, the flow control gate system 100 will return to its active mode.

In any event, the flow control gate system 100 will automatically reset itself if there is no presence and if any extended programmed alarm is completed or disabled.

On top of the aforementioned functions, the flow control gate system 100 can also deliver a true count, in real time of the traffic entering the store and can be linked to other electronic systems to study and control traffic in the store, time of the day clientele profile, forecast rushes at the cashiers and much more.

It can thus be easily appreciated that the above-described non-restrictive illustrative embodiments. More specifically, the gate and associated method of operation enable accurate detection and tracking of the flow of individual detectable items, such as persons, animals or objects passing through the gate, calculation of their position, speed, direction, etc. and taking appropriate actions, without the need for a motor driven barrier arm or turnstile, thereby providing accurate flow control as a turnstile.

Although the flow control gate system has been described in the foregoing Detailed Description and illustrated in the accompanying Figures, it will be understood that the flow control gate system and associated method are not limited to the embodiments disclosed, but are capable of numerous rearrangements, modifications and substitutions, without departing from the scope of the claims.

What is claimed is:

1. A method for monitoring a flow of a detectable item through a passageway, the method comprising:

generating detection signals indicative of a presence of the detectable item, wherein the generating is performed by narrow beam presence sensors provided along the passageway, from an entry end to an exit end;

sequentially reading each one of the detection signals from each one of the sensors at predetermined time intervals;

for a given time interval, allocating a detection value to each one of the sensors, the detection value for each one of the sensors being zero (0) if a detection period of the detection signal of the each one of the sensors is less than a predetermined value and one (1) if the detection period is equal to or larger than the predetermined value;

generating an item variable when, from a first reading time interval to a second reading time interval, the detection value of a first sensor (S1) adjacent to one of the entry end and the exit end passes from zero (0) to one (1); and the detection value of a second sensor (S2) adjacent to the first sensor either passes from one (1) to zero (0) or stays at zero (0);

storing the detection values in the corresponding item variable for a plurality of time intervals;

calculating a position number representative of a physical position of the item in the passageway at a given time interval by summing the detection values in the item variable for the time interval and dividing the result by a number of consecutive sensors having a detection value that is different from zero (0) for the item variable; and calculating a flow of the item variable using the position number of the item variable at consecutive time intervals.

2. The method of claim 1, wherein sequentially reading comprises allocating a weight value to each presence sensors, wherein calculating the position number comprising using the weight value for weighted averaging the detection values.

3. The method of claim 1, wherein sequentially reading signals from the plurality of narrow beam presence sensors at predetermined time intervals comprises maintaining an ON status for a predetermined period to avoid triggering inappropriate detection signal.

4. The method of claim 1, wherein allocating a detection value to each sensor comprises allocating a dimensional variable to each sensor, the dimensional variable comprising a position variable.

5. The method of claim 1, wherein storing detection values representative of an item in the corresponding item variable for a plurality of time intervals comprises incrementing an item counter to track the number of items.

6. The method of claim 1, further comprising producing an alarm sound when a flow of an item variable has a value within a predetermined range.

7. The method of claim 1, further comprising blocking the passageway when a flow of an item variable has a value within a predetermined range.

* * * * *